US007878483B2

(12) United States Patent
Van Der Laan

(10) Patent No.: US 7,878,483 B2
(45) Date of Patent: Feb. 1, 2011

(54) WINCH

(75) Inventor: Markus Van Der Laan, Oegstgeest (NL)

(73) Assignee: Machine & Lierenfabriek C. Kraaijeveld b.v., Sliedrecht (NL)

( * ) Notice: Subject to any disclaimer, the term of this patent is extended or adjusted under 35 U.S.C. 154(b) by 0 days.

(21) Appl. No.: 12/523,621

(22) PCT Filed: Jan. 18, 2008

(86) PCT No.: PCT/NL2008/050034

§ 371 (c)(1),
(2), (4) Date: Aug. 27, 2009

(87) PCT Pub. No.: WO2008/088220

PCT Pub. Date: Jul. 24, 2008

(65) Prior Publication Data

US 2010/0044660 A1 Feb. 25, 2010

(30) Foreign Application Priority Data

Jan. 18, 2007 (NL) ..... 2000443

(51) Int. Cl.
*B66D 1/00* (2006.01)

(52) U.S. Cl. ..... 254/323; 254/277; 254/365; 254/370

(58) Field of Classification Search ..... 254/323, 254/274, 275, 277, 365, 366, 370
See application file for complete search history.

(56) References Cited

U.S. PATENT DOCUMENTS 3,469,821 A 9/1969 Gross
3,612,486 A * 10/1971 Martin et al. ..... 254/267
3,901,478 A * 8/1975 Peterson ..... 254/270
4,004,780 A 1/1977 Kuzarov
4,275,870 A * 6/1981 Henneman et al. ..... 254/361
4,444,375 A * 4/1984 Horn ..... 254/346
4,610,139 A * 9/1986 Skelly ..... 60/327
4,625,946 A * 12/1986 Clark et al. ..... 254/274
6,843,313 B2 * 1/2005 Hult ..... 166/78.1

(Continued)

FOREIGN PATENT DOCUMENTS

AU 434584 B 4/1973

(Continued)

OTHER PUBLICATIONS

International Search Report dated May 14, 2008, in PCT application.

*Primary Examiner*—Emmanuel M Marcelo
(74) *Attorney, Agent, or Firm*—Young & Thompson

(57) ABSTRACT

Ship's winch including a frame which can be attached to a vessel and on which the cable drum and the motor driving the cable drum are provided. Adjacent to the cable drum, a slipping clutch is provided and between slipping clutch and the motor, a freewheel mechanism is provided which works towards the frame. The slipping clutch is embodied not to transmit further load to the freewheel mechanism or motor, respectively, in case of a certain overload caused by tension in the towing cable. In addition, by positioning the freewheel mechanism/clutch in this manner, the motor output for pulling in a certain load under greatly varying stresses can be reduced.

18 Claims, 5 Drawing Sheets

U.S. PATENT DOCUMENTS

2005/0161655 A1 7/2005 Copp

FOREIGN PATENT DOCUMENTS

| | | |
|---|---|---|
| DE | 19757500 | 8/1999 |
| GB | 1117452 | 6/1968 |
| GB | 1357022 | 6/1974 |
| JP | 05238680 | 9/1993 |
| NL | 8501649 | 1/1987 |

* cited by examiner

WINCH

The present invention present invention relates to a winch.

A winch of this type is known from U.S. Pat. No. 4,004,780. This document discloses a winch for a vehicle, which has a special feature so that it is possible to pay out the cable when the freewheel mechanism is active. In this way, it is possible to prevent the situation where the user disengages the freewheel mechanism when the cable is being paid out in the unloaded state and forgets to engage the freewheel mechanism again later. This winch for a vehicle is provided with an overload protection. The overload protection comprises a clutch, which acts to a greater or lesser degree between two parts by twisting said two parts with respect to one another, in combination with a cam construction. This clutch is directly connected to a freewheel mechanism which dissipates the overload to the frame (earth). The embodiment is such that the force coming from the drum is transferred to one of the parts, and from the one part (gear) on the one hand dissipated to the other part and the clutch and thus, in the case of an overload, to the earth, and is dissipated, in parallel with this flow of forces, directly from the one part to the motor by means of a splined connection and an optional deceleration. Such a system is inherently unsafe, because when the clutch fails, the freewheel mechanism is no longer effective and the motor will be overloaded, with all the consequences this entails.

Prior-art ship's winches which are suitable to be used at greatly fluctuating loads use a centrally fitted cable drum. On one side thereof, a brake is provided while on the other side a motor is provided which is connected to a clutch (possibly via a transmission). In cases of extreme overload, the clutch can be disengaged and the system is locked by means of the brake. In this case, this results in the problem that when the cable is pulled in under great load, the cable is held, in the starting position, by means of the brake and a transition has to take place from operation of the brake to operation of the clutch, that is to say that the motor has to take over the tensile force required for pulling in or holding the cable by activating the clutch and releasing the brake. In order to enable all this to take place in a satisfactory manner, the various operations have to be synchronized and a considerable motor output is required.

It is an object of the present invention to provide a simplified ship's winch which can be operated in a relatively simple manner and requires a relatively small motor output. This applies in particular to operating conditions where the tensile force varies.

With a ship's winch described above, this object is achieved in that said freewheel mechanism operates between said winch motor and winch clutch, and said winch comprises a ship's winch, which is provided with attachment means for attachment to a part of a vessel.

According to the present invention, the ratchet or freewheel mechanism is provided between the motor and the clutch. As a result thereof, at failure of the clutch the ratchet will be jerked into action and the motor will still be protected.

According to the present invention, a ratchet or freewheel mechanism is used in combination with the known clutch. In this case, the ratchet or freewheel mechanism acts towards the surroundings (earth) and is provided downstream (behind) of the clutch with respect to the cable drum. As a result thereof, the clutch can act in the usual manner as a safeguard, that is to say as a slipping clutch. Primarily, however, this safeguard acts on the ratchet system. That is to say the part downstream of the ratchet system, being an optional transmission and motor, is not subjected to any overload at all. Applying load to the winch cable is very simple using the construction which is proposed here, as the action of the ratchet is cancelled out when the motor output is increased and the winch drum can transfer the force to the cable via the clutch. In this case, it is no longer necessary to carry out the operation of the brake required in the prior art.

In addition, as a result of the invention, it is now possible to absorb the effects of a temporary reduction in the load. Such a reduction in the load occurs, for example, when a vessel is being towed and, for example, the tension of the towing cable is reduced as a result of the motion of the waves. When the tension builds up again, this may result in large tensile forces and in the occurrence of correspondingly large loads. In the case of a prior-art structure of a ship's winch which uses a brake, it is not readily possible to apply a relatively low tension on the towing cable during such periods. With the present invention, this is made possible in a very simple and automatic manner. After all, if the motor supplies sufficient power (preferably a hydro motor), the effect of the ratchet will be overcome when the load is reduced and the winch drum will tension the cable further. When the load subsequently increases, the ratchet will become active again and thus protect the motor against overload. Should the load increase further still, the (slipping) clutch will become active, thus preventing the cable from breaking.

As, according to the present invention, there no longer is a brake drum, there only remains one slipping function which has to be controlled, namely in the drum. Active operation can no longer result in damage to the motor as the ratchet will become active in such cases.

With the above-described system, a single slipping function in the clutch suffices and it is no longer necessary to provide one in the clutch and the brake.

According to an advantageous embodiment of the invention, the clutch is embodied as having a bowl or drum and clutch shoes which act on the peripheral surface thereof and work in such a manner that all this is not self-actuating.

The above-described ship's winch is designed for exerting a clutch force on the drum of at least ten tons.

If, in an advantageous embodiment, a fluid is used to cool the heat which has been produced during operation, the fluid flow between the various heat-producing parts and an added cooling device is passed through the clutch shaft. Such a fluid may be a hydraulic fluid which, for example, can also be used to operate the clutch.

In addition, a torque sensor may be provided in order to control the system.

In the case of the ship's winch according to the invention, the transmission and other parts of the drive mechanism, such as the motor, may be of a relatively light construction compared to the prior-art constructions. The presence of the ratchet after all ensures that no overload can occur. The motor may, for example, have a drive torque which is approximately 10% of the desired maximum clutch force.

In order to pay out the cable, either the clutch is operated (uncoupled) or the ratchet is operated. In addition, further measures may be taken on the ratchet in order to refine the operation thereof. By way of example, the use of damping materials may be mentioned in order to attenuate the return movement of the pawl on the teeth as much as possible.

The invention also relates to a vessel which is provided with a ship's winch of this type. More particularly, such a variant comprises a buffer in the cable between the winch and the object to be displaced.

The invention will be explained in more detail below with reference to an exemplary embodiment illustrated in the drawing, in which.

Figure 4:
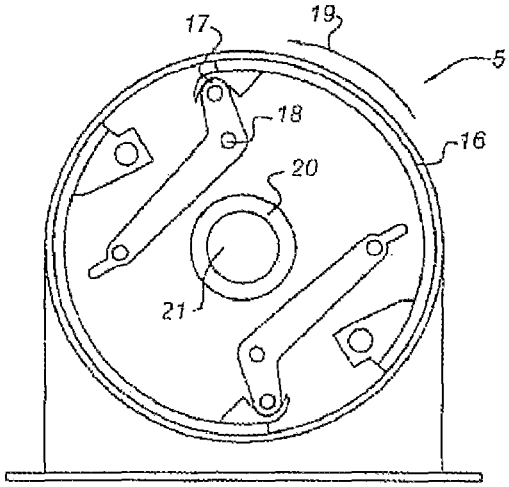
Figure 5:
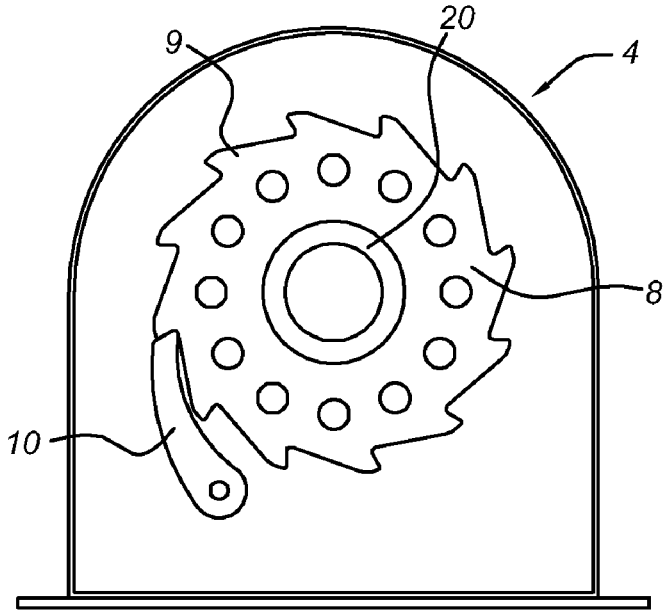
Figure 6:
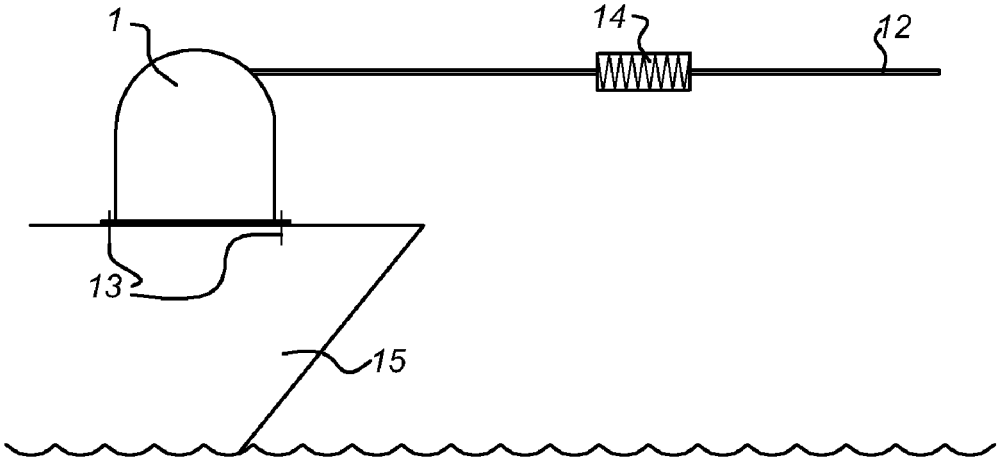
Figure 7A:
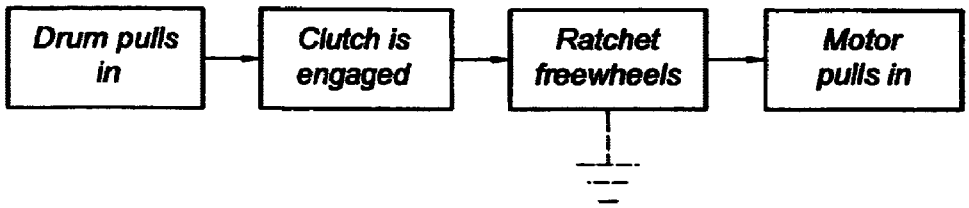
Figure 7B:
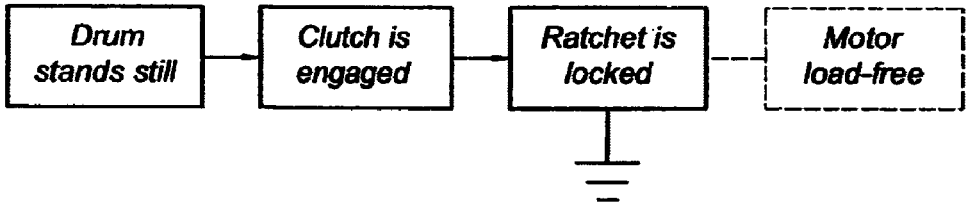
Figure 7C:
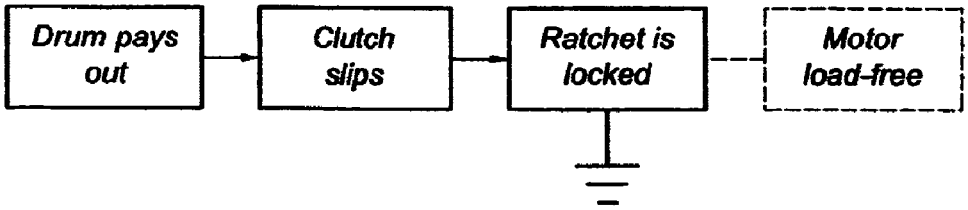
Figure 8A:
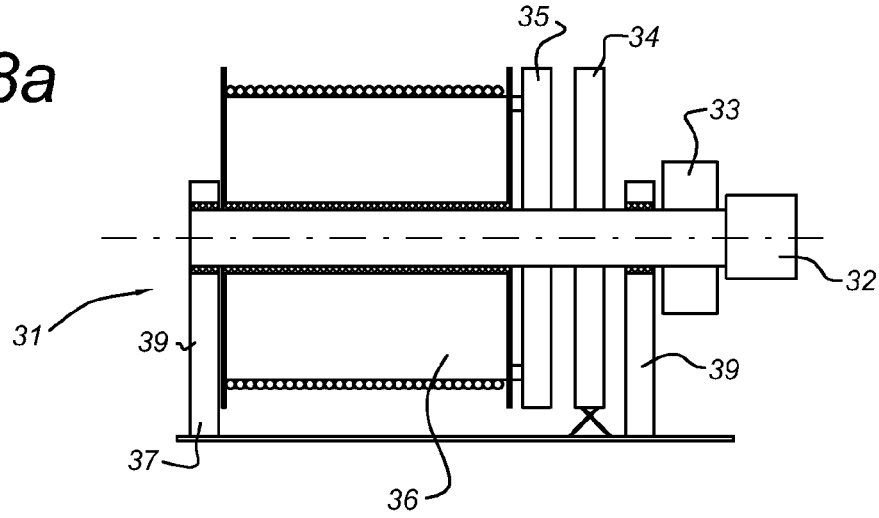
Figure 8B:
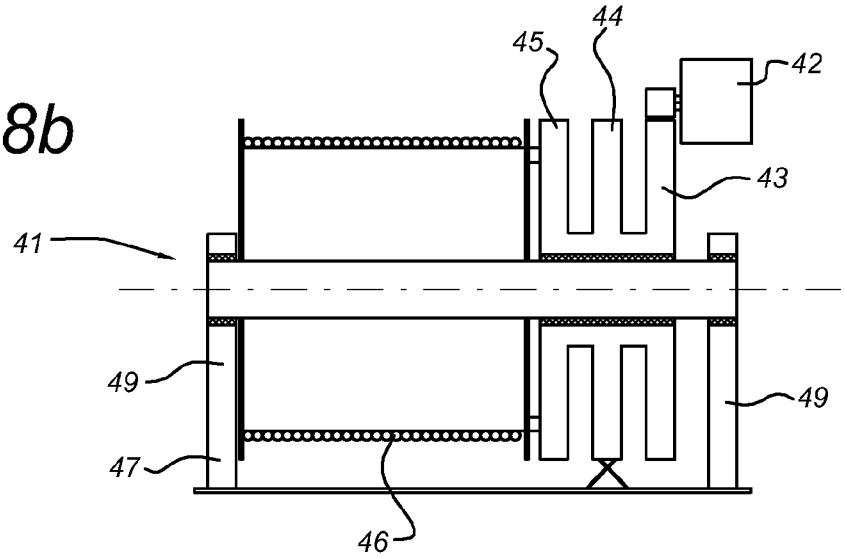
Figure 8C:
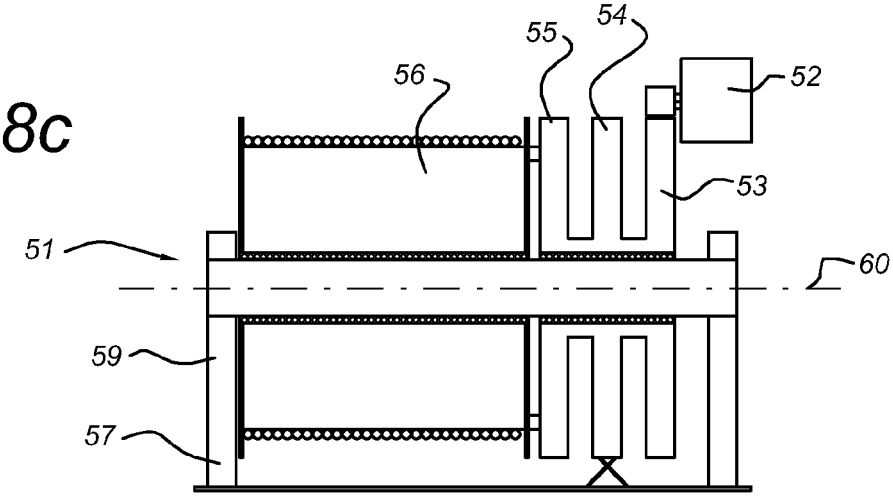

FIG. 4 diagrammatically shows the operation of the clutch according to the invention;

FIG. 5 shows a cross section through the ratchet;

FIG. 6 shows a part of a vessel provided with a ship's winch according to the invention;

FIGS. 7*a-c* diagrammatically show three different operating states according to the invention; and FIGS. 8*a-c* diagrammatically show three concept drive mechanisms bearing mechanisms of alternative embodiments.

In FIGS. 1-7, a first embodiment of the ship's winch according to the invention is denoted overall by reference numeral 1. It comprises a frame 7 to which is rotatably fitted an assembly comprising a cable drum 6 for accommodating or paying out a cable 12. This frame 7 can be attached to the deck of a ship by means of bolts 13. It is possible to provided reinforcements on the deck or below the deck as a result of which the forces of the winch can be introduced more readily into the structure of the vessel.

Such a reinforcement may comprise a supporting frame provided belowdecks to which the bolts of the winch are attached. Adjacent to the cable drum 6 and preferably on the same shaft, a clutch 5 is provided. On the other side of the clutch 5, a ratchet/freewheel mechanism denoted by reference numeral 4 is provided, the other end of which is in turn connected to a transmission, such as the gearwheel train 3 which can be driven by a motor 2.

FIG. 4 shows the clutch 5 in more detail. It comprises a drum 16 which is preferably fixedly connected to the cable drum 6. Arranged rotatably in the latter is a plate on which a pair of clutch shoes 17 are mounted. The rotatable shaft 20 of the plate is preferably connected to the ratchet/freewheel mechanism 4. Hingably about a shaft 18, the shoes 17 can be forced inwards and outwards by means of a mechanism which is not shown in any more detail in order to produce the disengaged or engaged position, respectively. A fluid duct 21 extends through the central shaft.

Figure 1:
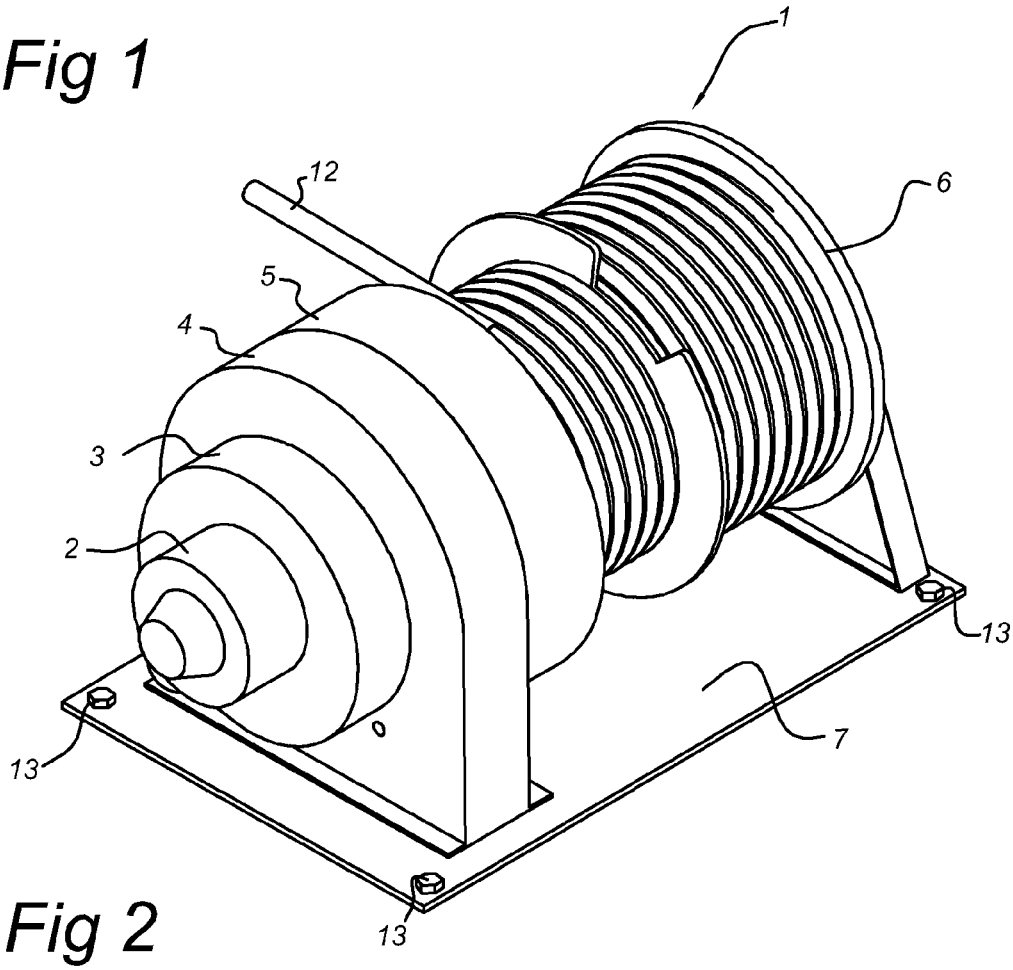
FIG. 1 shows the ship's winch according to the invention in a first position.
Figure 2:
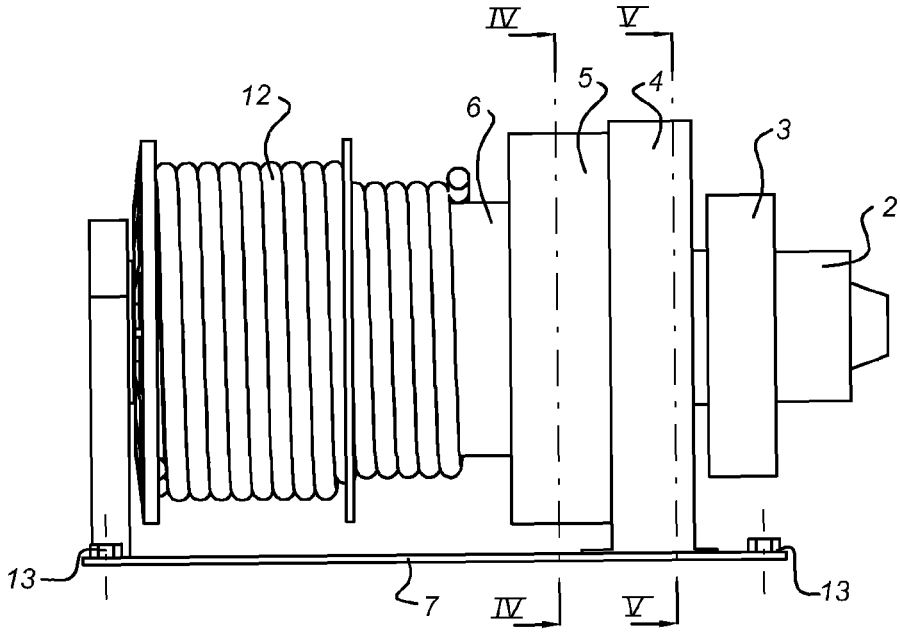
FIG. 2 shows the ship's winch from FIG. 1 in a further position.
Figure 3:
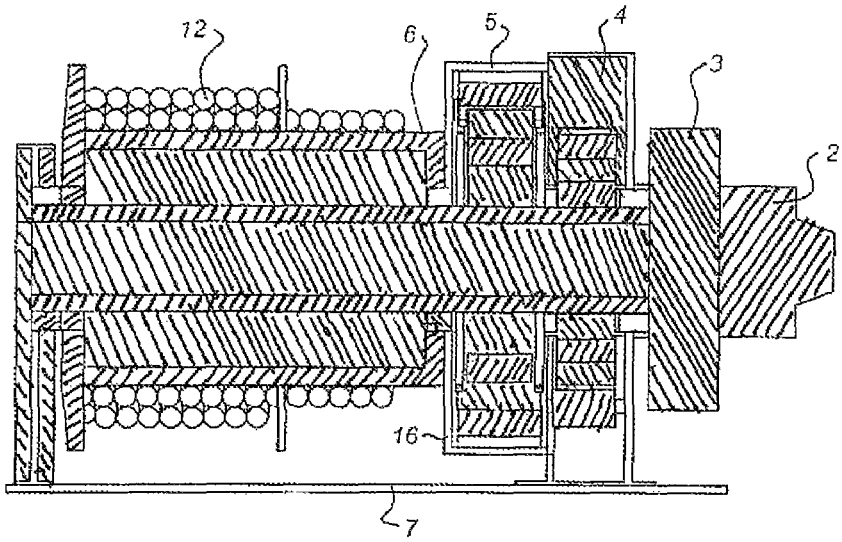
FIG. 3 shows a cross section of the ship's winch according to the invention.

As is clear from FIGS. 1 and 5, the ratchet consists of a central rotating part or ratchet wheel 8 which is provided with teeth 9. A number of ratchet pawls 10 are present and fixedly connected to the frame. These can be pressed against the ratchet wheel by spring pressure and according to a particular embodiment of the invention, the ratchet pawls 10 can be operated in such a manner that the teeth 9 are forced away. This may be effected, for example, by means of a disk (not shown) which rotates about the shaft 20 of the assembly and is provided with pins by means of which the pawls can be forced outwards. Other (electromagnetic) constructions are also conceivable.

According to an advantageous embodiment of the invention, the operation of the ratchet pawl is dependent on the maximum permissible torque of the drive mechanism. This is achieved by decreasing the slip value of the clutch accordingly. Consequently, damage to the drive mechanism as a result of excessive torque is prevented if the ratchet pawl is not operational. Damping means may be provided in any suitable way in order to prevent noise pollution and impact of the ratchet during operation as much as possible. This applies in particular to the damping of the striking movement of part 10 against ratchet wheel 8. In addition, it is possible for ratchet pawls 10 not to be rigidly connected to the surroundings directly via their hinge pin, but rather to provide some suitable form of damping material, as a result of which the force increases gradually when the pawls 10 become operational. Other damping structures may also be provided, such as cable guides on the deck of the respective vessel.

FIG. 6 shows a part of a vessel 15 to which the ship's winch 1 according to the invention is attached by means of bolts 13. The forces present in the cable are slightly dampened by means of a buffer 14.

The operation of the structure described above will be described with reference to FIG. 3. In order to pay out cable 12, it is possible to either operate the clutch 5 in such a manner that it slips or to make the ratchet/freewheel mechanism non-operational. When a load has subsequently been attached to the cable 12, pulling in of the latter can be started. To this end, the motor is switched on. This motor 2 is preferably a hydro motor, that is to say a motor which can produce a significant torque at low revolutions without this causing damage to the motor. Initially, at a relatively low load, this situation will not occur and the cable 12 will be pulled in by means of the transmission 3, ratchet 4 and clutch 5. Then, the cable is taut and subjected to peak loads due to the swell of the sea or other conditions during the operation of the motor. During the initial stage, these peak loads are, on the one hand, sufficiently high to result in damage of the motor, but, on the other hand, not sufficiently high to cause the cable to break. At this stage, as a result of the drum standing still and possibly turning back, the ratchet 4 becomes operational which prevents any return movement via the transmission to the motor and avoids damage. If the load on the cable 12 increases to the extent where the latter might break, the slip safeguard of the clutch 5 becomes operational, resulting in paying out of the cable.

However, as soon as circumstances change to such an extent that the load on the cable 12 is reduced again (swell of the sea), the cable can be pulled taut immediately without further intervention. After all, the motor will be able to supply power to the clutch and thus to the drum again via the ratchet. Consequently, the required motor output can be reduced to a considerable extent. In addition, the risk of slack cables and in particular the subsequent jerking motion when the latter are pulled tight again is significantly reduced. The structure is relatively strong and simple, which reduces failure and maintenance costs. Clearly distinct positions of either brakes or motor output as are known from the prior art do not occur to such a discrete extent in the present invention. Use of such a ratchet makes gradual and direct transitions from one position to the other position possible.

In the case of a ship's winch having a tensile load of, for example, fifty tons, the clutch is designed in such a manner that slip occurs when the load of fifty tons is exceeded. However, the ratchet, in combination with the motor, is embodied in such a manner that already at a load of twenty tons no power is transferred to the transmission and the motor. If the load of the clutch is measured using the moment of torque, a correction is preferably made in order to allow for variations in the distance of the point of engagement of the cable on the drum. After all, using the same tensile force on the cable, a higher torque will be applied when the drum is full than when the drum is empty. Measuring, in particular, the distance of the cable to the centre of the drum can be carried out by means of any conceivable structure.

FIGS. 7*a-c* shows different operating states of the ship's winch according to the invention by way of example.

FIGS. 8*a-c* shows different variants of the ship's winch described above.

The variant in FIG. 8*a* is denoted overall by reference numeral 31. Frame 37 comprises two bearing supports 39 for bearing the centre shaft.

Motor 32, together with a transmission 33 which is coupled thereto, is arranged on one side of such a bearing support, while the ratchet 34, clutch 35 and drum 36 are arranged on the other side. The drum 36 is mounted on the centre shaft.

FIG. 8*b* shows a variant, in which the bearing supports 49 of frame 47 form the outermost boundary of the structure. Motor 42 is attached to the frame in a separate location. Transmission 43, ratchet pawl 44 and clutch 45 are mounted on the same common shaft. The drum 46 is fixedly connected to the common shaft.

FIG. 8*c* shows a variant, in which supports 59 of frame 57 are not designed as bearing supports. Shaft 60 is a fixed shaft and the various parts are mounted on this shaft. This is in contrast to the variant according to FIG. 7*b*, in which the drum shaft is mounted in the bearing supports 49, and the variant according to 7*a*, in which the output shaft of the transmission is mounted in the bearing supports 39.

Although the invention has been described above with reference to a preferred embodiment, it will be understood that numerous modifications can be made thereto without departing from the scope of the present application. Thus, it is possible to construct both the ratchet and the clutch in every other conceivable way. In addition, it will be understood that further components may be present between the various components described above, i.e. that the clutch, for example, does not have to be connected directly to the drum, but that, if desired, a transmission can be provided inbetween. In addition, it is possible to provide further safety measures. Thus, it is possible to specify that the winches have an additional brake which becomes operational when the clutch or ratchet fails. In addition, the motor may be provided behind the gearbox or next to it. The centre shaft may be mounted in any conceivable position, such as between the gearbox and the ratchet, or "outside" the ratchet or motor, respectively. These and other variants are within the scope of the invention as described in the attached claims.

The invention claimed is:

1. A winch comprising:

a frame;

a winch motor;

a cable drum;

a freewheel mechanism; and a winch clutch, wherein said freewheel mechanism providing a fixed connection to said frame, depending on the rotation and operation, and said winch clutch is arranged between said freewheel mechanism and said cable drum said freewheel mechanism operating between said winch motor and winch clutch, and said winch comprises a ship's winch, which is provided with attachment means for attachment to a part of a vessel.

2. The winch as claimed in claim 1, comprising a transmission which is arranged between said motor and said freewheel mechanism.

3. The winch as claimed in claim 1, wherein said clutch comprises a slipping clutch.

4. The winch as claimed in claim 1, wherein said clutch comprises a slipping clutch with overload protection.

5. The winch as claimed in claim 1, wherein said clutch comprises a bowl and clutch shoes which act on a peripheral surface thereof.

6. The winch as claimed in claim 1, wherein said clutch is embodied in such a manner that, when the cable drum rotates when a cable is unwound, it is not self-actuating.

7. The winch as claimed in claim 1, further comprising:

a ratchet capable of being engaged or disengaged.

8. The winch as claimed in claim 7, wherein the slip value of said clutch can be set and, when said ratchet is disengaged, said slip value is set to the maximum permissible torque for the drive mechanism.

9. The winch as claimed in claim 1, embodied for exerting a clutch force of at least ten tons on the winch drum.

10. The winch as claimed in claim 1, comprising a fluid cooling system for said clutch.

11. The winch as claimed in claim 10, wherein said fluid cooling system comprises operating fluid for said clutch.

12. The winch as claimed in claim 10, wherein said drum further comprises a centre shaft, the centre shaft provided with a fluid duct.

13. The winch as claimed in claim 1, comprising a torque sensor.

14. The winch as claimed in claim 1, wherein the distance of the tensile force acting on the drum to the centre of the drum is measured.

15. A vessel comprising:

a ship's winch, said winch comprising:

a frame;

a winch motor;

a cable drum;

a freewheel mechanism; and a winch clutch, wherein said freewheel mechanism, providing a fixed connection to said frame, depending on the rotation and operation, and said winch clutch is arranged between said freewheel mechanism and said cable drum said freewheel mechanism operating between said winch motor and winch clutch, and said winch provided with attachment means for attachment to a part of a vessel.

16. The vessel as claimed in claim 15, wherein the ship's winch cooperates with a cable buffer provided on the vessel.

17. A method for operating a ship's winch, comprising: a frame, a winch motor, a cable drum, a freewheel mechanism and a winch clutch, wherein said freewheel mechanism providing a fixed connection to said frame, depending on the rotation and operation, and wherein said winch clutch is arranged between said freewheel mechanism and said cable drum said freewheel mechanism operating between said winch motor and winch clutch, and said winch comprises a ship's winch, which is provided with attachment means for attachment to a part of a vessel wherein said clutch is operated in such a manner that slip occurs when a specific load in said winch drum is exceeded.

18. The method as claimed in claim 17, wherein said specific load can be set and read.

* * * * *